US005163886A

United States Patent [19]

Seol

[11] Patent Number: 5,163,886

[45] Date of Patent: Nov. 17, 1992

[54] EXERCISING AND REHABILITATION APPARATUS

[75] Inventor: Marn T. Seol, Taichung, Taiwan

[73] Assignee: Augustine Rheem, North Brunswick, N.J.

[21] Appl. No.: 561,163

[22] Filed: Aug. 1, 1990

[51] Int. Cl.[5] ..... A63B 21/02

[52] U.S. Cl. ..... 482/57; 482/52

[58] Field of Search ..... 272/70, 73; 482/57, 482/60, 61, 63, 52, 53

[56] References Cited

U.S. PATENT DOCUMENTS

| | | | |
|---|---|---|---|
| 3,704,886 | 12/1972 | Kay et al. | 272/73 |
| 3,759,543 | 9/1973 | Clark . | |
| 4,077,648 | 3/1978 | Seul . | |
| 4,161,328 | 7/1979 | Efros . | |
| 4,272,096 | 6/1981 | Efros . | |
| 4,300,784 | 11/1981 | Efros . | |
| 4,421,334 | 12/1983 | Efros . | |
| 4,441,705 | 4/1984 | Brown | 272/73 |
| 4,574,649 | 3/1986 | Seol | 280/251 |
| 4,630,839 | 12/1986 | Seol . | |
| 4,949,993 | 8/1990 | Stark et al. | 272/70 |

FOREIGN PATENT DOCUMENTS

| | | |
|---|---|---|
| 128003 | 2/1902 | Fed. Rep. of Germany . |
| 578438 | 9/1924 | France . |
| 30243 | 3/1975 | Japan . |
| 17068 | 2/1978 | Japan . |
| 122539 | 9/1979 | Japan . |
| 6170 | 1/1980 | Japan . |
| 6171 | 1/1980 | Japan . |
| 151689 | 1/1980 | Japan . |
| 31503 | 3/1981 | Japan . |
| 159593 | 6/1982 | Japan . |
| 39585 | 3/1983 | Japan . |
| 199279 | 11/1983 | Japan . |
| 610936 | 10/1948 | United Kingdom . |
| 667655 | 5/1952 | United Kingdom . |

*Primary Examiner*—Stephen R. Crow
*Attorney, Agent, or Firm*—Ralph W. Selitto, Jr.

[57] ABSTRACT

An exercise and/or rehabilitation apparatus is provided with a stationary frame and a pair of pedals pivotally mounted to the frame. The pedals can be pivoted in an up and down manner which allows an operator to assimilate a walking or jogging motion.

24 Claims, 11 Drawing Sheets

EXERCISING AND REHABILITATION APPARATUS

FIELD OF THE INVENTION

The present invention relates to exercising and rehabilitation apparatus, and, more particularly, to exercising and rehabilitation apparatus in the form of a lever-operated stationary bicycle.

BACKGROUND OF THE INVENTION

Stationary bicycles have been used for many years to strengthen the muscles associated with walking and jogging. More particularly, stationary bicycles have been used for both daily exercise and routine rehabilitation of such joints as the knee, hip and ankle. However, almost two-thirds of the 360 degree circular motion associated with conventional stationary bicycles is non-productive since the range of motion that effectively produces resistance is only 130 degrees. Also, the full circular pedal motion of these bicycles requires 115 degrees of knee flexion which is much more flexion than is required in normal walking or jogging motion. Thus, conventional stationary bicycles are unable to produce leg motion which uses the same body muscles as walking or jogging, and are unable to promote early rehabilitation after knee, hip, or ankle surgeries which require less than 115 degrees of knee flexion. In fact, many rehabilitation efforts using the full cycling motion irritate the injured joint of patients with range of motion limitations.

SUMMARY OF THE INVENTION

In accordance with the present invention, an exercise and/or rehabilitation apparatus comprises a stationary frame, a first pedal, and a second pedal. The first and second pedals are pivotally mounted to the frame such that the first pedal is pivotable in a first arcuate direction from an up position to a down position and in a second arcuate direction from its down position to its up position and such that the second pedal is pivotable in the first arcuate direction from an up position to a down position and in the second arcuate direction from its down position to its up position. More particularly, the first pedal can be pivoted in the first arcuate direction without causing the pivotal movement of the second pedal in the first arcuate direction. The first pedal can also be pivoted in the second arcuate direction without causing the pivotal movement of the second pedal in the second arcuate direction. Similarly, the second pedal can be pivoted in the first arcuate direction without causing the pivotal movement of the first pedal in the first arcuate direction. The second pedal can also be pivoted in the second arcuate direction without causing the pivotal movement of the first pedal in the second arcuate direction. As a result of the foregoing, the first and second pedals are movable alternately between their up positions and their down positions to thereby allow an operator to move the pedals in a manner which assimilates a walking or jogging motion.

In one embodiment of the present invention, an oscillating mechanism is employed to automatically return the first pedal to its up position from its down position as the second pedal is moved from its up position to its down position and to automatically return the second pedal to its up position from its down position as the first pedal is moved from its up position to its down position. Thus, the oscillating mechanism functions to define both the up position and the down position of each of the pedals.

In another embodiment of the present invention, a stop mechanism is employed to define the down position of each of the pedals. The stop mechanism, which functions independently of the pedals such that the motion of one pedal does not effect the motion of the other pedal, includes a pair of stop-bars which can be extended into the path of the pedals, thereby limiting the pedals to pivotal motion, or retracted out of the path of the pedals, thereby enabling full circular motion of the pedals.

BRIEF DESCRIPTION OF THE DRAWINGS

For a more complete understanding of the present invention, reference is made to the following detailed description of two exemplary embodiments considered in conjunction with the accompanying drawings, in which.

DETAILED DESCRIPTION OF THE EXEMPLARY EMBODIMENTS

Figure 1:
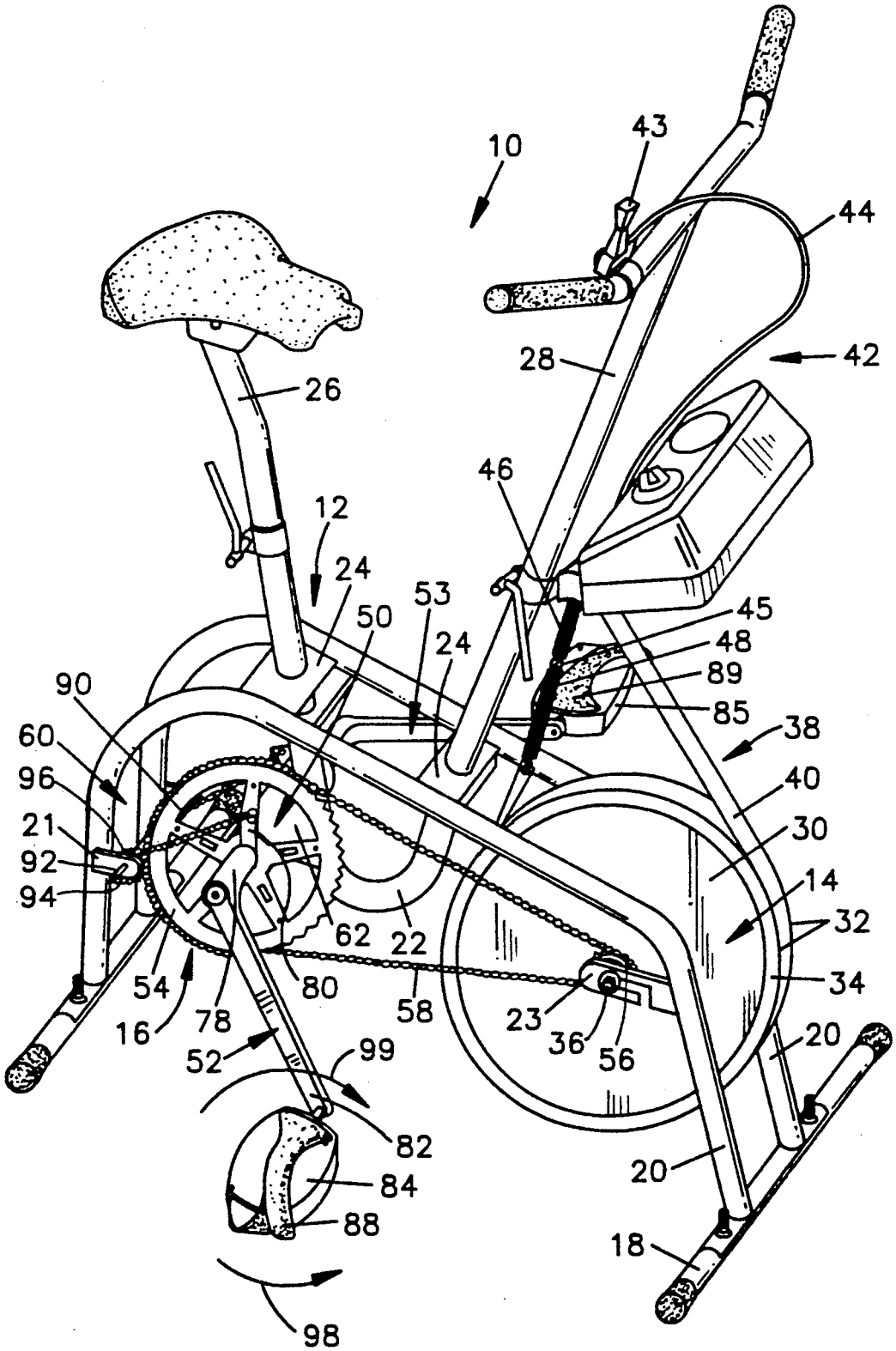
FIG. 1 is a perspective view, taken from the right side, of one exemplary embodiment of an exercise bicycle constructed in accordance with the present invention, the bicycle being shown with its right pedal in a "down" position and its left pedal in an "up" position.

Referring to FIGS. 1-4, an exercise bicycle 10 includes a frame assembly 12, a wheel assembly 14, and a transmission assembly 16. The frame assembly 12 includes a base 18, two support shafts 20, a U-shaped shaft 22, two rear brackets 21, two front brackets 23, and two joining members 24. An adjustable seat 26 is mounted on one leg of the U-shaped shaft 22, while an adjustable handlebar 28 is mounted on the other leg of the U-shaped shaft 22.

The wheel assembly 14, which is located between the two support shafts 20 and attached to each of the front brackets 23 at the front end of the exercise bicycle 10, includes a wheel 30, having two flanges 32 extending from each edge of a wheel rim 34, a wheel axle 36, and a resistance mechanism 38 for providing a frictional resistance force on the wheel 30. The resistance mechanism 38 includes a belt 40 which is wrapped around most of the circumference of the wheel 30 between the two flanges 32, such that friction between the wheel rim 34 and the belt 40 is created, and a tension control mechanism 42 for varying the tension between the belt 40 and the wheel 30. One end of the belt 40 is fixedly attached directly to the handlebar shaft 28, while the other end is attached to the handlebar shaft 28 by the tension control mechanism 42, which includes a tension shifter 43, a pull wire 44, a first spring 46, and a second spring 48. One end of the pull wire 44 is connected to the tension shifter 43, while the other end of the pull wire 44 is connected between the first spring 46 and the second spring 48 by a nut and bolt member 45. While the wheel assembly 14 is shown in a position such that it is free to rotate around its own axis, the wheel assembly 14 could be placed anywhere within the frame assembly 12 or on rollers or the like such that friction is created with a ground-like surface.

The transmission assembly 16, which rotates the wheel assembly 14, includes a hub assembly 50, which is fixedly attached to the frame assembly 12; a pair of crank-levers 52 and 53, each of which is pivotally mounted to the hub assembly 50; a large sprocket 54, which is fixedly mounted to the hub assembly 50; a small sprocket 56, which is fixedly attached to the wheel assembly 14; an endless chain 58, which is trained around the first sprocket 54 and the second sprocket 56; and an oscillating mechanism 60, which causes the interdependent operation of the crank-levers 52 and 53 in a manner to be further described hereinafter and which limits the motion of the crank-levers 52 and 53 to pivoting motion, as opposed to full circular motion.

Figure 5:
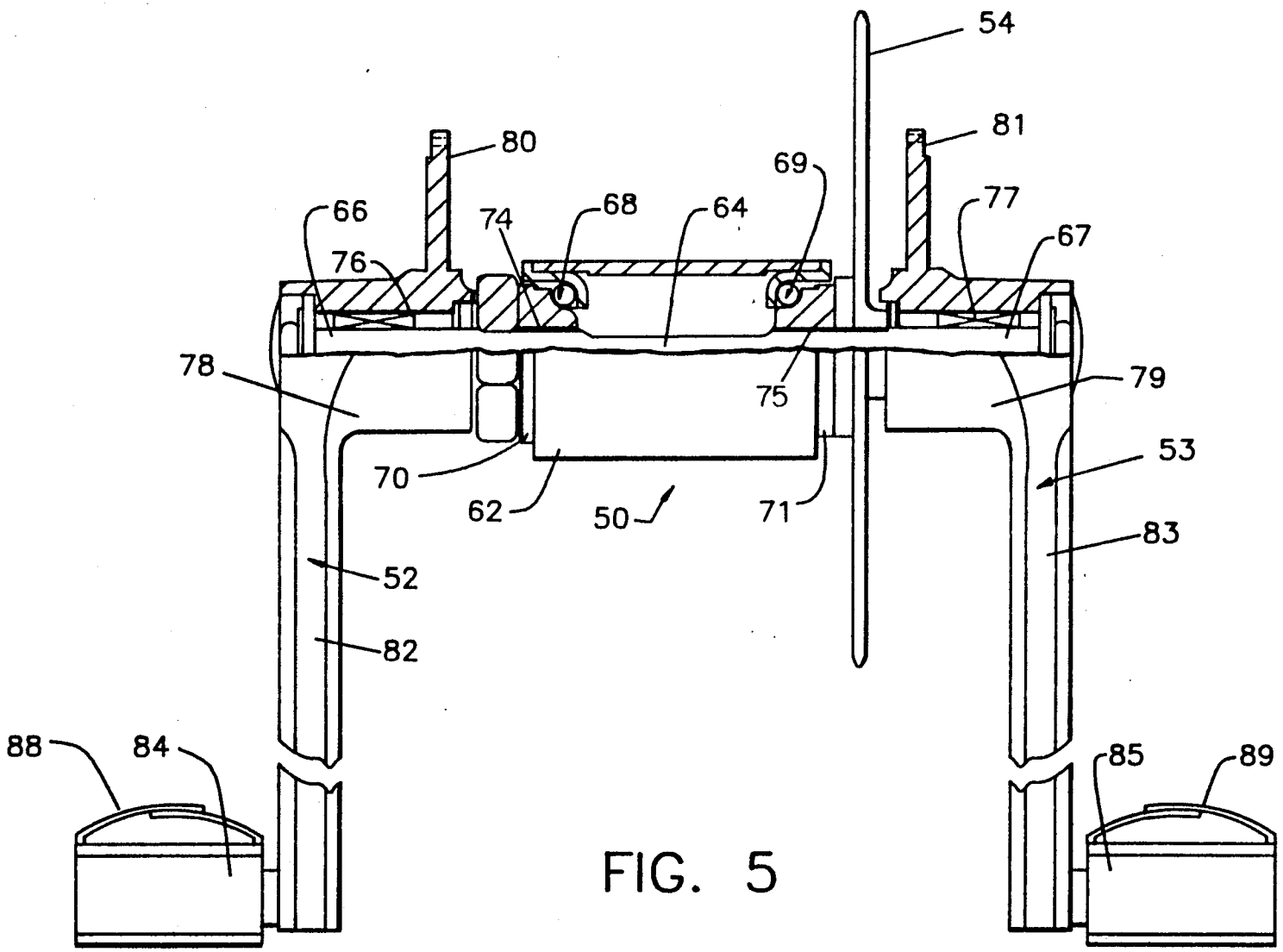
FIG. 5 is a front elevational view of a hub assembly employed by the exercise bicycle illustrated in FIGS. 1–4, a portion of the hub assembly being broken away to facilitate consideration and discussion.

Referring to FIG. 5, the hub assembly 50 includes an outer shell 62, which is fixedly attached to the frame; a spindle 64, extending through the shell 62 and terminating in two ends 66 and 67; a pair of ball bearing arrangements 68 and 69; and a pair of containing caps 70 and 71.

The end 66 of the spindle 64 is packed by the ball bearing arrangement 68 to facilitate the rotation of the spindle 64. The end 66 of the spindle 64 extends through a hole 74 in the containing cap 70, which seals the ball bearing arrangement 68 in the shell 62. The crank-lever 52 is attached to the end 66 of the spindle 64 by a one-way clutch 76 such that the end 66 of the spindle 64 becomes a fulcrum 78 about which the crank-lever 52 can pivot up and down. The one-way clutch 76 is a conventional drawn cup roller clutch such as Model FCB 20 manufactured by The Torrington Company. The operation of the one-way clutch 76 will be further described hereinafter.

The crank-lever 52 includes a short end 80 for creating a short load arm to activate the oscillating mechanism 60, a long end 82 for creating a long lever arm to move the load arm, and a pedal 84 for creating a place for the user to apply force to the lever arm. The short end 80 is located on the side of the fulcrum 78 facing the rear of the exercise bicycle 10, while the long end 82 is located on the side of the fulcrum 78 facing the front of the exercise bicycle 10. The pedal 84 is rotatably mounted to the long end 82 of the crank-lever 52 such that downward pressure on the top of the pedal 84 moves the pedal 84 and the long end 82 downward conjointly. The pedal 84 has an adjustable strap 88 which secures a user's foot to the pedal 84 and thereby allows the user to raise the crank-lever 52 by lifting up on the pedal 84. While the size and shape of the crank-lever 52 and the positioning of the pedal 84 on the long end 82 are shown to be fixed in this embodiment, they could be made adjustable so as to accommodate user's with longer or shorter legs.

The end 67 of the spindle 64 is packed by the ball bearing arrangement 69 to facilitate the rotation of the spindle 64. The end 67 of the spindle 64 extends through a hole 75 in the containing cap 71, which seals the ball bearing arrangement 69 in the shell 62. The crank-lever 53 is attached to the end 67 of the spindle 64 by a one-way clutch 77 such that the end 67 of the spindle 64 becomes a fulcrum 79 about which the crank-lever 53 can pivot up and down. The one-way clutch 77 is a conventional drawn cup roller clutch such as Model FCB 20 manufactured by The Torrington Company. The operation of the one-way clutch will be further described hereinafter.

The crank-lever 53 includes a short end 81 for creating a short load arm to activate the oscillating mechanism 60, a long end 83 for creating a long lever arm to move the load arm, and a pedal 85 for creating a place for the user to apply force to the lever arm. The short end 81 is located on the side of the fulcrum 79 facing the rear of the exercise bicycle 10, while the long end 83 is located on the side of the fulcrum 79 facing the front of the exercise bicycle 10. The pedal 85 is rotatably mounted to the long end 82 of the crank-lever 53 such that downward pressure on the top of the pedal 85 moves the pedal 85 and the long end 83 downward conjointly. The pedal 85 has an adjustable strap 89 which secures a user's foot to the pedal 85 and thereby allows the user to raise the crank-lever 53 by lifting up on the pedal 85. While the size and shape of the crank-lever 53 and the positioning of the pedal 85 on the long end 83 are shown to be fixed in this embodiment, they could be made adjustable so as to accommodate user's with longer or shorter legs.

Referring to FIGS. 1-5, the large sprocket 54 is fixedly attached to the end 66 of the spindle 64 between the containing cap 70 and the crank-lever 52 such that the large sprocket 54 rotates conjointly with the spindle 64 in a clockwise direction as indicated by arrow 99. The small sprocket 56 is fixedly attached to the wheel assembly 14 in the same vertical plane as the large sprocket 54. The endless chain 58 connects the large sprocket 54 to the small sprocket 56 such that when the large sprocket 54 rotates in the clockwise direction indicated by the arrow 99 the small sprocket 56 is caused to rotate in the same direction.

Figure 6:
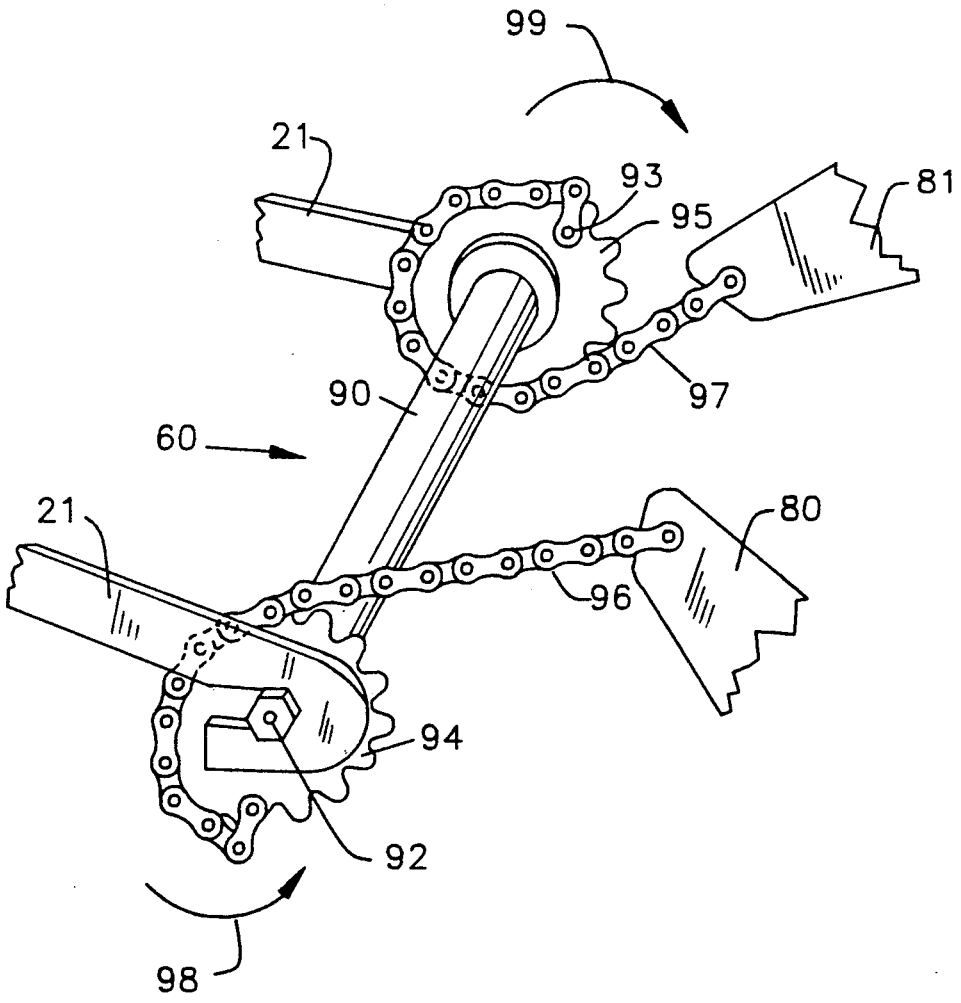
FIG. 6 is a perspective view of an oscillating mechanism employed by the exercise bicycle illustrated in FIGS. 1–4, the oscillating mechanism being shown in a position which it assumes when the pedals are in the positions illustrated in FIGS. 1 and 3.
Figure 7:
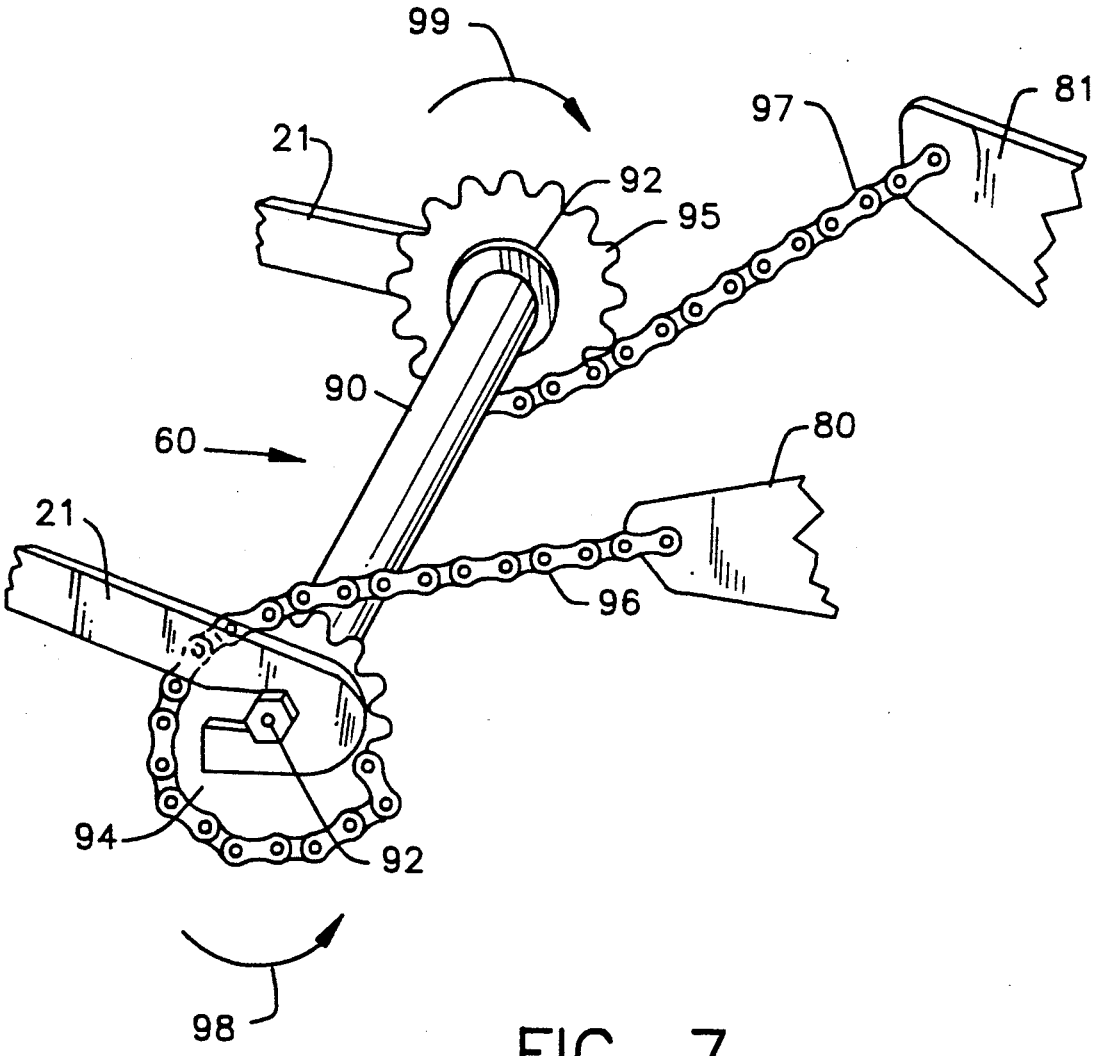
FIG. 7 is a perspective view of the oscillating mechanism illustrated in FIG. 6, the oscillating mechanism being shown in a position which it assumes when the pedals are in the positions illustrated in FIGS. 2 and 4.

Referring to FIGS. 6 and 7, the oscillating mechanism 60 includes a rear axle 90 having ends 92 and 93, which are rotatably mounted between the rear brackets 21 at the rear of the bicycle 10; a pair of equally-sized sprockets 94 and 95; and a pair of chain segments 96 and 97. The sprocket 94 is fixedly attached to the end 92 of the rear axle 90 in the same vertical plane as the short end 80 of the crank-lever 52. The chain segment 96 connects the sprocket 94 to the crank-lever 52. More particularly, one end of the chain segment 96 is connected to the short end 80 of the crank-lever 52, while the other end is connected to the sprocket 94 such that the chain segment 96 is wrapped around a lower portion of the sprocket 94. The sprocket 95 is fixedly attached to the end 93 of the rear axle 90 in the same vertical plane as the short end 81 of the crank-lever 53. The chain segment 97 connects the sprocket 95 to the crank-lever 53. More particularly, one end of the chain segment 97 is connected to the short end 81 of the crank-lever 53, while the other end is connected to the sprocket 95 such that the chain segment 97 is wrapped around a lower portion of the sprocket 95.

The interdependent operation of the oscillating mechanism 60 and the crank-levers 52 and 53 will be further described hereinafter. However, it should be noted that the configuration of the chain segments 96 and 97, the sprockets 94 and 95, and the rear axle 90 could be in any manner so long as the depression of either crank-lever 52 or 53, respectively raises the other crank-lever 53 or 52 without the operator having to intervene.

To operate the bicycle 10, an operator sits on the seat 26, holds the handlebar 28 with each hand and puts his feet on the pedals 84 and 85. The operator makes repeated up and down motion (oscillating motion) of the pedals 84 and 85 and thereby oscillates the attached crank-levers 52 and 53. In order to begin a detailed explanation of how this invention operates, the starting position will be assumed to be that position shown in FIGS. 1, 3, and 6 in which the pedal 84 is in its "down" position and the pedal 85 is in its "up" position. In such a starting position, the chain segment 96, as illustrated specifically by FIG. 6, is in an extended position in which the chain segment 96 is unwrapped from the sprocket 94, and the crank-lever 52 is in its "down" position. The chain segment 97 is in a contracted position, in which the chain segment 97 is wrapped around the sprocket 95, and the crank-lever 53 is in its "up" position.

Referring to FIGS. and 3, as the pedal 85 is depressed, the one-way clutch 77 located in the crank-lever 53 becomes engaged such that it permits the transfer of torque between the crank-lever 53 and the end of the spindle 67, which thereby causes the spindle 64 to rotate. The spindle 64, in turn, rotates the large sprocket 54 causing the teeth of the large sprocket 54 to engage the links of the chain 58 and thereby revolve the chain 58 around the large sprocket 54 and the small sprocket 56. Since the small sprocket 56 is smaller than the large sprocket 54 the revolving action of the chain 58 around the small sprocket 56 causes the small sprocket 58 to rotate faster than the large sprocket 56. The rotation of the small sprocket 58 causes the wheel axle 38 to rotate. The rotational forces of the wheel axle 38 are transferred to the wheel 30 and the resistive belt 42, thereby impeding the rotation of the wheel 30.

Since the crank-lever 53 is pivotally mounted to the spindle 64, depression of the pedal 85 not only causes the long end 83 of the crank-lever 53 to move downward, but also causes the short end 81 of the crank-lever 53 to move upward. The upward motion of the short end 81 causes the chain segment 97 to rotate the sprocket 95 and hence the rear axle 90 in the direction indicated by the arrow 98, thereby causing the sprocket 94 to rotate in the same direction (see FIG. 6). As the sprocket 94 rotates in the direction of the arrow 98, the chain segment 96 is wound around the sprocket 94, thereby pulling the short end 80 of the crank-lever 52 in a downward direction. As the short end 80 moves downward, the clutch mechanism 76 becomes disengaged such that torque is no longer transferred between the crank-lever 52 and the spindle 64, which thereby allows the long end 82 to freely pivot about the fulcrum 78 and to move the pedal 84 upward. As the downward motion of the pedal 85 continues, the pedal 84 continues to move in an upward direction. When the pedal 85 reaches its "down" position, the pedal 84 assumes its "up" position. This position represents half of an operating cycle. It should be noted that the pedal 85 can move slightly past the "down" position, but that it is prevented from moving in a full circular motion because the chain segment 97 becomes fully extended from the sprocket 95, thereby limiting the downward motion of the crank-lever 53. Also, the pedal 84 can move slightly past the "up" position, but it is prevented from moving in a full circular motion because the attached chain segment 96 becomes fully wound around the sprocket 94, thereby limiting the upward motion of the crank lever 52.

Figure 2:
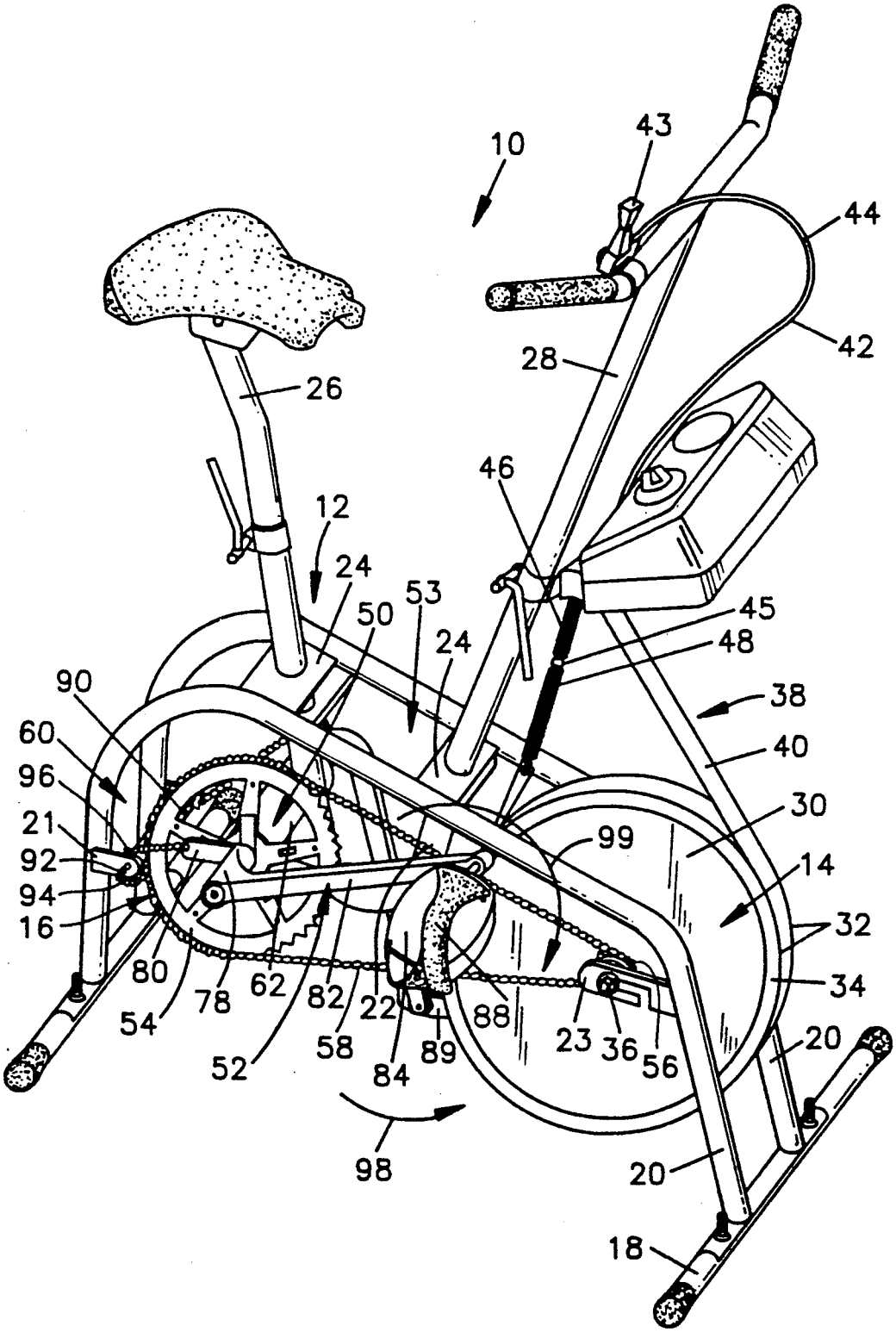
FIG. 2 is a perspective view, taken from the right side, of the exercise bicycle of FIG. 1, the bicycle being shown with its right pedal in an "up" position and its left pedal in a "down" position.
Figure 3:
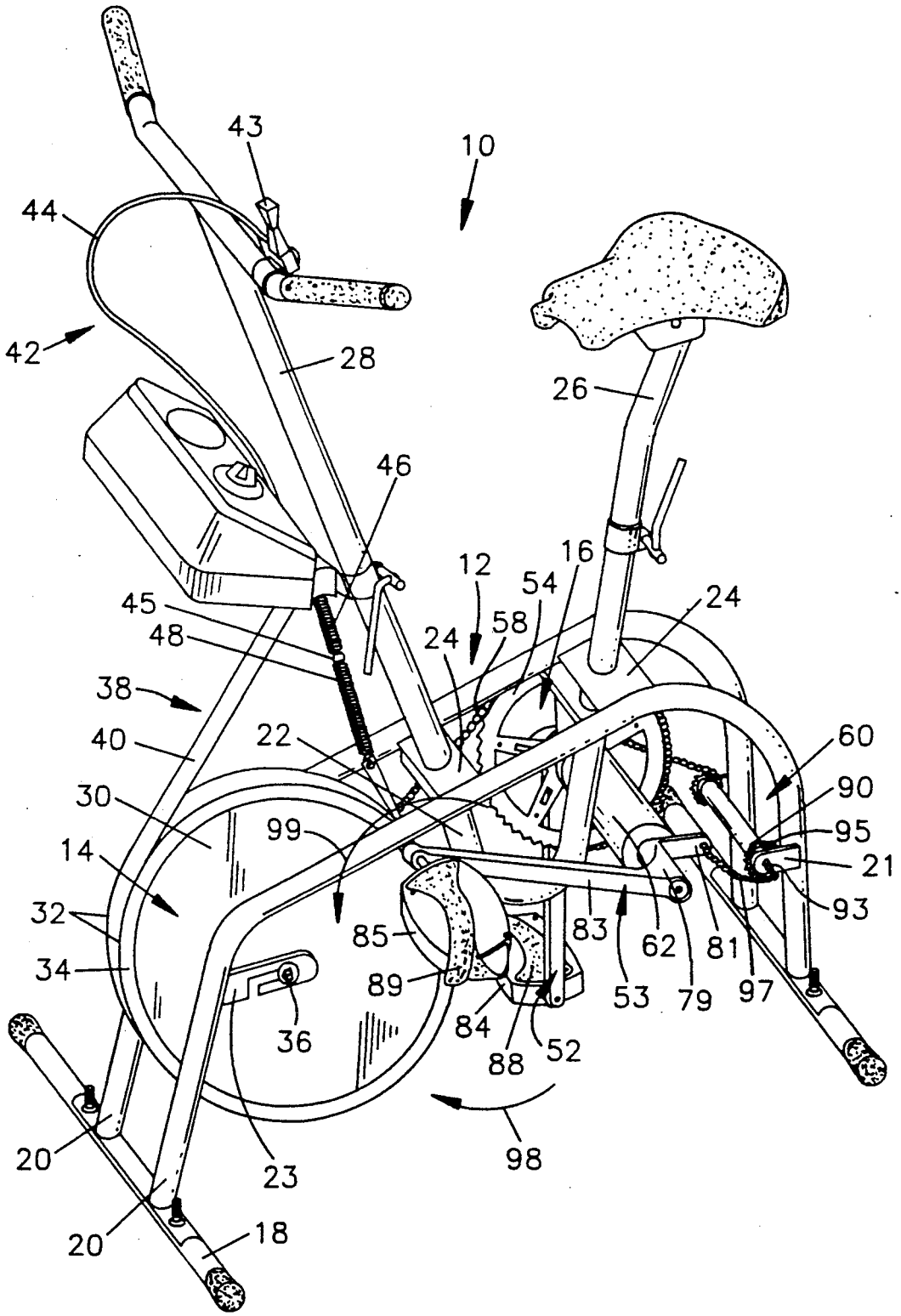
FIG. 3 is a perspective view, taken form the left side, of the exercise bicycle illustrated in FIG. 1.
Figure 4:
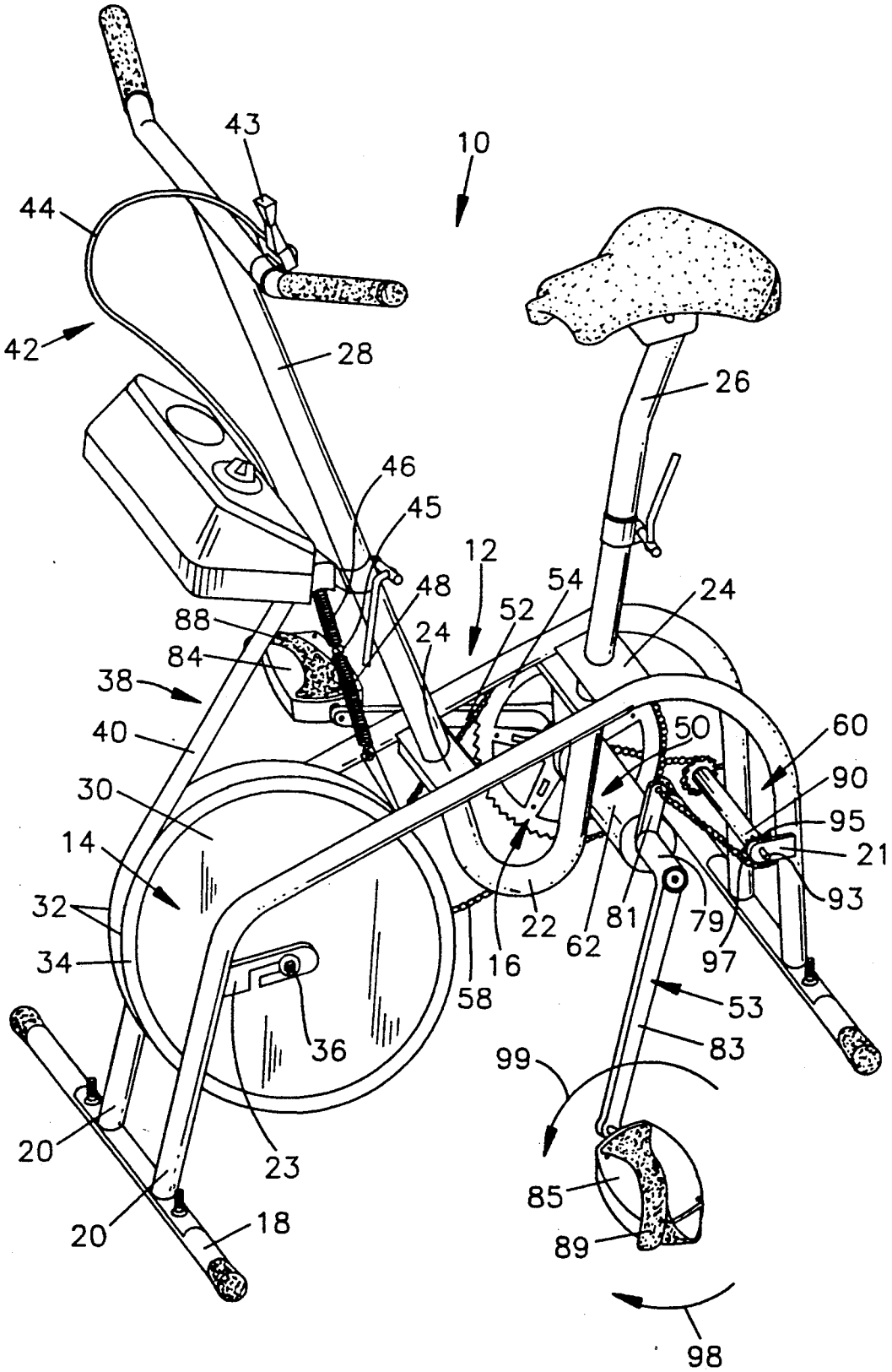
FIG. 4 is a perspective view, taken form the left side, of the exercise bicycle illustrated in FIG. 2.

At the half-way position, which is shown in FIGS. 2, 4 and 7, the operator must now apply downward pressure to the pedal 84 in order to complete the full operating cycle. At this point, the chain segment 96, as illustrated specifically in FIG. 7, is in a contracted position, in which the chain segment 96 is wrapped around the sprocket 94, and the crank-lever 52 is in its "up" position. The chain segment 97 is in an extended position, in which the chain segment 97 is unwrapped from the sprocket 95, and the crank-lever 53 is in its "down" position.

Referring to FIGS. 2 and 4, as the pedal 84 is depressed, the one-way clutch 76 located in the crank-lever 52 becomes engaged such that it permits the transfer of torque between the crank-lever 52 and the end of the spindle 66, which thereby causes the spindle 64 to rotate. The spindle 64, in turn, rotates the large sprocket 54 causing the teeth of the large sprocket 54 to engage the links of the chain 58 and thereby revolve the chain 58 around the large sprocket 54 and the small sprocket 56. Since the small sprocket 56 is smaller than the large sprocket 54 the revolving action of the chain 58 around the small sprocket 56 causes the small sprocket 58 to rotate faster than the large sprocket 56. The rotation of the small sprocket 58 causes the wheel axle 38 to rotate. The rotational forces of the wheel axle 38 are transferred to the wheel 30 and the resistive belt 42, thereby impeding the rotation of the wheel 30.

Since the crank-lever 52 is pivotally mounted to the spindle 64, depression of the pedal 84 not only causes the long end 82 of the crank-lever 52 to move downward, but also causes the short end 80 of the crank-lever 52 to move upward. The upward motion of the short end 80 causes the chain segment 96 to rotate the sprocket 94 and hence the rear axle 90 in the direction indicated by the arrow 99, thereby causing the sprocket 95 to rotate in the same direction (see FIG. 7). As the sprocket 95 rotates in the direction of the arrow 99, the chain segment 97 is wound around the sprocket 95, thereby pulling the short end 81 of the crank-lever 53 in a downward direction. As the short end 81 moves downward, the clutch mechanism 77 becomes disengaged such that torque is no longer transferred between the crank-lever 53 and the spindle 64, which thereby allows the long end 81 to freely pivot about the fulcrum 79 and to move the pedal 85 upward. As the downward motion of the pedal 84 continues, the pedal 85 continues to move in an upward direction. When the pedal 84 reaches its "down" position, the pedal 85 assumes its "up" position. This position represents the completion of a full operating cycle. In order to begin another operating cycle the operator must apply downward pressure to the pedal 85. It should be noted that the pedal 84 can move slightly past the "down" position, but that it is prevented from moving in a full circular motion because the chain segment 96 becomes fully extended from the sprocket 94, thereby limiting the downward motion of the crank-lever 52. Also, the pedal 85 can move slightly past the "up" position, but it is prevented from moving in a full circular motion because the attached chain segment 97 becomes fully wound around the sprocket 95, thereby limiting the upward motion of the crank lever 53.

Since both of the crank-levers 52 and 53 are pivotally mounted to the hub assembly 50, the operator is not required to exert any more knee flexion than is exerted in a walking or a jogging motion. When either pedal 84 or pedal 85 is depressed, the respective crank-lever 52 or 53 traverses an arc of about 130 degrees, which thereby requires about 90 degrees of knee flexion in order for the operator to pedal the bicycle 10.

The operator can change the resistive force exerted on the wheel 30 by increasing the tension in the resistive belt 40. When the tension shifter 43 is moved upward, the pull wire 44 moves upward such that the first spring 46 contracts and the second spring 48 expands. Expansion of the second spring 48 pulls the resistive belt 40 upward, thereby creating more resistance between the resistive belt 40 and the wheel 30. More resistance between the wheel and resistive belt requires more downward force to be exerted by the operator on the pedals 84 and 85, which makes it harder to rotate the wheel 30. When the tension shifter 43 is moved downward, the pull wire 44 moves downward such that the first spring 46 expands and the second spring 48 contracts. Contraction of the second spring 48 permits the resistive belt 40 to move downward, thereby creating less resistance between the resistive belt 40 and the wheel 30. Less resistance between the wheel and resistive belt requires less downward force to be exerted by the operator on the pedals 84 and 85, which makes it easier to rotate the wheel 30.

Another exemplary embodiment of the present invention is illustrated in FIGS. 8–12. The various elements illustrated in FIGS. 8–12 which correspond to elements described above with respect to the embodiment illustrated in FIGS. 1–7 are designated by corresponding reference numerals increased by one hundred. All additional elements illustrated in FIGS. 8–12 which do not correspond to elements described above with respect to FIGS. 1–7 are designated by reference numerals increased by two hundred. Unless otherwise stated, the embodiment of FIGS. 8–12 operates in the same manner as the embodiment of FIGS. 1–7.

Figure 8:
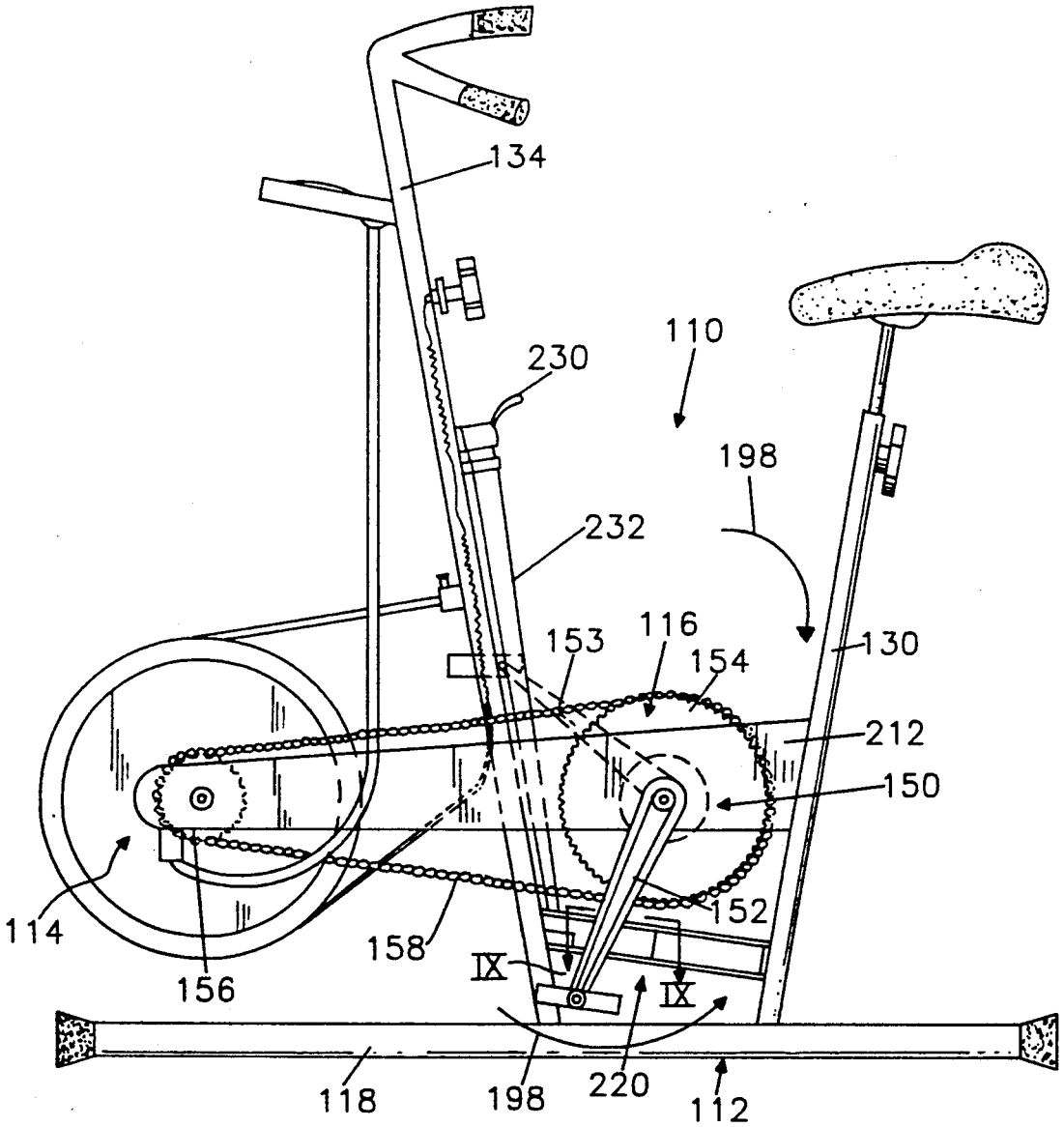
FIG. 8 is an elevational view, taken from the left side, of another exemplary embodiment of an exercise bicycle constructed in accordance with the present invention.

With reference to FIG. 8, a lever-operated exercise bicycle 110 has a frame assembly 112, a wheel assembly 114, and a transmission assembly 116. The frame assembly 112 includes a base 118, a seat shaft 130, a handlebar shaft 134, and a support bracket 212. The seat shaft 130 and the handlebar shaft 134 are fixedly attached to the base 118 such that the seat shaft 130 extends upward from the base 118 towards the rear of the bicycle 110 and such that the handlebar shaft 134 extends upward from the base 118 towards the front of the bicycle 110. The support bracket 212 is connected to the seat shaft 130 and to the handlebar shaft 134 such that the wheel assembly 114 and the transmission assembly 116 can be attached thereto and supported thereby. While FIG. 8 shows the wheel assembly 114 attached at the front of the bicycle 110, it could be placed at the back of the bicycle 110.

The transmission assembly 116, which rotates the wheel assembly 114, includes a hub assembly 150, which is fixedly attached to the support bracket 212, a pair of crank-levers 152 and 153, each of which is pivotally mounted to the hub assembly 150; a large sprocket 154, which is fixedly mounted to the hub assembly 150; a small sprocket 156, which is fixedly attached to the wheel assembly 114; an endless chain 158, which is trained around the large sprocket 154 and the small sprocket 156; and a stop-bar mechanism 220, which can permit the crank-levers 152 and 153 to operate in either full circular motion or partial circular (i.e., pivoting) motion. The significant difference between the exercise bicycle 10 of FIGS. 1–7 and the exercise bicycle 110 is the replacement of the oscillating mechanism 60 with the stop-bar mechanism 220. The characteristics and function of the stop-bar mechanism 220 will be described hereinafter.

Figure 9:
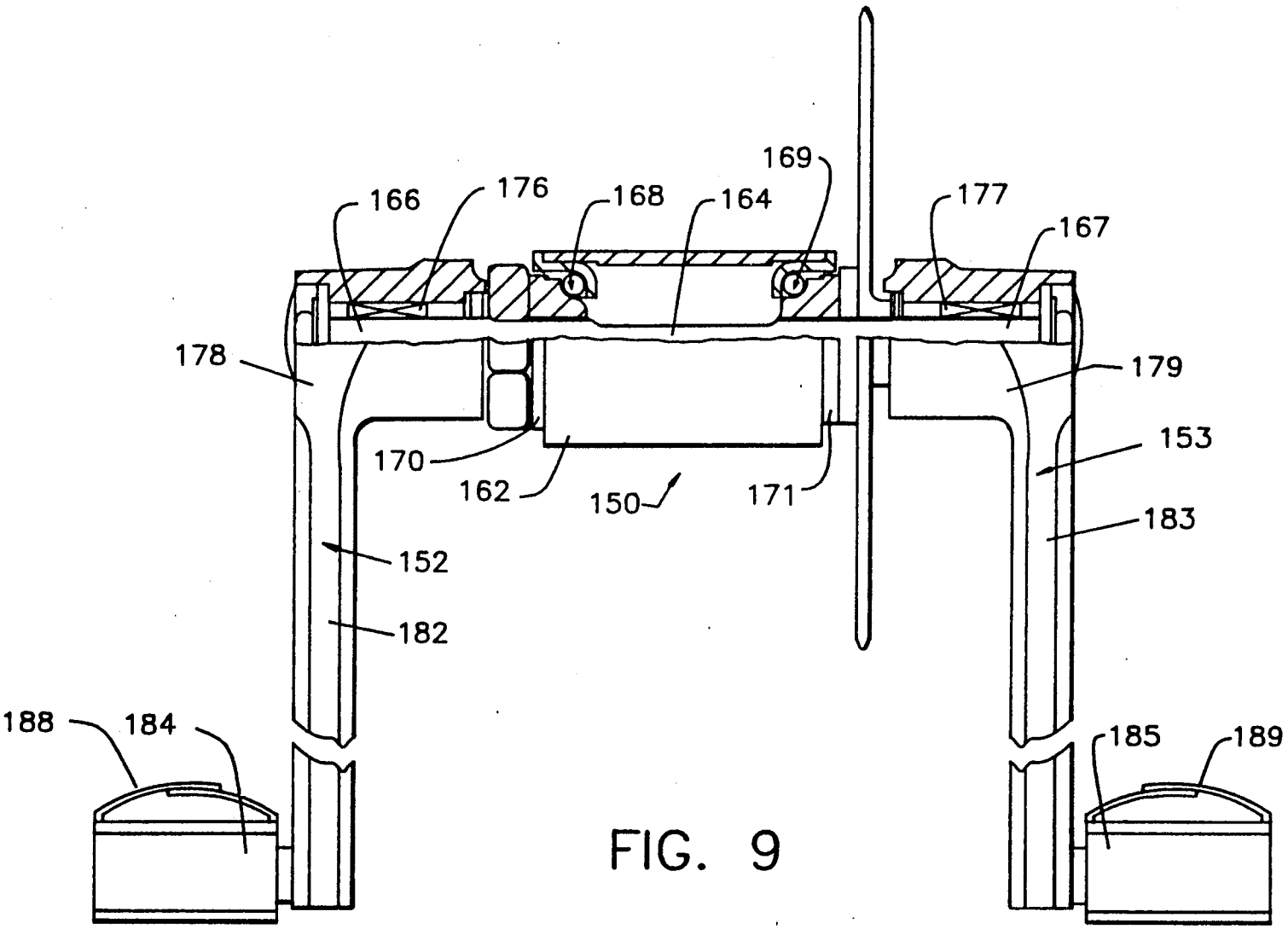
FIG. 9 is a front elevational view of a hub assembly employed by the exercise bicycle illustrated in FIG. 8, a portion of the hub assembly being broken away to facilitate consideration and discussion.

The hub assembly 150, which is illustrated in FIG. 9, includes an outer shell 162, which is fixedly attached to the frame assembly 112; a spindle 164, extending through the shell 162 and terminating in two ends 166 and 167; a pair of ball bearing arrangements 168 and 169; and a pair of containing caps 170 and 171.

The crank-lever 152 is attached to the end 166 of spindle 164 by a one-way clutch 176 such that the end 166 of the spindle 164 becomes a fulcrum 178 about which the crank-lever 152 can pivot up and down. The one-way clutch 176 is a conventional drawn cup roller clutch such as Model FCB 20 manufactured by The Torrington Company. The crank-lever 152 includes a long end 182 extending outward from the fulcrum 178, and a pedal 184 rotatably attached to the long end 182 such that downward pressure on the top of the pedal 184 moves the pedal 184 and the long end 182 downward conjointly. The pedal 184 has an adjustable strap 188 which secures a user's foot to the pedal 184 and thereby allows the operator to raise the crank-lever 152 by lifting up on the pedal 184.

The crank-lever 153 is attached to the end 167 of the spindle 164 by a one-way clutch 177 such that the end 167 of the spindle 164 becomes a fulcrum 179 about which the crank-lever 153 can pivot up and down. The one-way clutch 177 is a conventional drawn cup roller clutch such as Model FCB 20 manufactured by The Torrington Company. The crank-lever 153 includes a long end 183 extending outward from the fulcrum 179, and a pedal 185 rotatably attached to the long end 183 such that downward pressure on the top of the pedal 185 moves the pedal 185 and the long end 183 downward conjointly. The pedal 185 has an adjustable strap 188 which secures a user's foot to the pedal 185 and thereby allows the user to raise the crank-lever 153 by lifting up on the pedal 185.

In the embodiment of FIGS. 8–12, the motion of either crank-lever 152 or 153 occurs independently of the motion of the other crank-lever 153 or 152. In other words, the motion of crank-lever 152 neither induces nor inhibits motion of the crank-lever 153, and the motion of crank-lever 153 neither induces nor inhibits motion of the crank-lever 152. However, the motion of both crank-levers 152 and 153 can be inhibited by the stop-bar mechanism 220.

Figure 10:
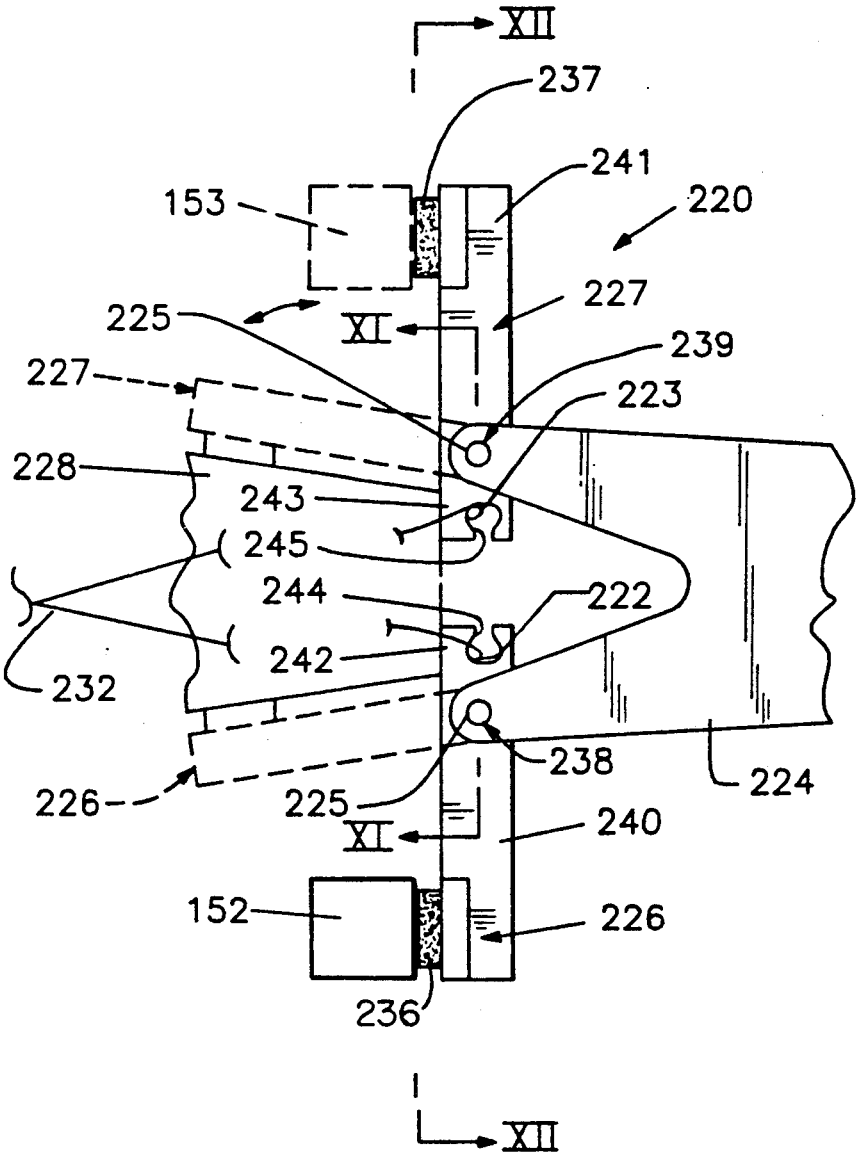
FIG. 10 is a plan view taken along line X—X of FIG. 8 and looking in the direction of the arrows, of a stop-bar mechanism employed by the exercise bicycle illustrated in FIG. 8.
Figure 11:
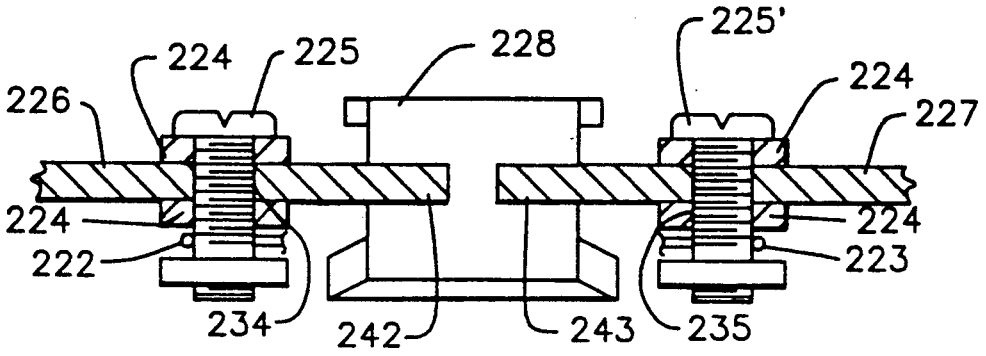
FIG. 11 is a cross-sectional view, taken along line XI—XI of FIG. 10 and looking in the direction of the arrows, of the stop-bar mechanism illustrated in FIG. 10.
Figure 12:
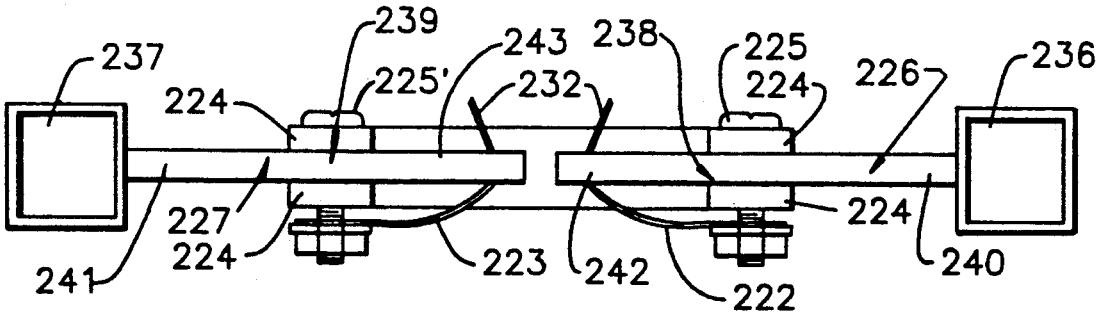
FIG. 12 is a cross-sectional view, taken along line XII—XII of FIG. 10 and looking in the direction of the arrows, of the stop-bar mechanism illustrated in FIG. 10.

The stop-bar mechanism 220, which is illustrated in detail in FIGS. 10–12, is connected to the frame assembly 112 for allowing the crank-levers 152 and 153 to perform either full circular motion or partial circular motion. The stop-bar mechanism 220 includes a stop-bar bracket 224, which is fixedly mounted to the seat shaft 130; a pair of stop-bars 226 and 227, which are pivotally attached to the stop-bar bracket 224; a stop-bar shifter 230, which controls engaging and disengaging of the stop-bars 226 and 227 into the path of the crank-levers 152 and 153; a pull wire 232, which is used to engage the stop-bars 226 and 227; a pair of twist springs 222 and 223, which have a spring force sufficient to disengage the stop-bars 226 and 227; and a stop bracket 228, which is fixedly mounted to the handlebar shaft 134 for preventing hyper-extension of the stop-bars 226 and 227 when they are engaged.

The stop-bar 226 has an off-center hole 234 through which a pin 225 is inserted for pivotally mounting the stop-bar 226 to the stop-bar bracket 224, whereby a fulcrum 238 is created such that there is a long portion 240 and a short portion 242. A cushion pad 236 is attached to the long portion 240 such that the crank-lever 152 contacts the cushion pad 236 when the stop-bar 226 is engaged. The pull wire 232 is attached from a notch 244 in the short portion 242 to the stop-bar shifter 230 such that the stop-bar shifter 230 moves the stop-bar 226 from its disengaged position (which is shown in phantom in FIG. 10) to its engaged position (which is shown in solid in FIG. 10) against the resisting force of the twist spring 222. The twist spring 222 is attached between the notch 242 on the stop-bar 226 and the stop-bar bracket 224 at the fulcrum 238 such that the twist spring 222 urges the stop-bar 226 into its disengaged position (which is shown in phantom in FIG. 10).

The stop-bar 227 has an off-center hole 235 through which a pin 225' is inserted for pivotally mounting the stop-bar 227 to the stop-bar bracket 224, whereby a fulcrum 238 is created such that there is a long portion 241 and a short portion 243. A cushion pad 237 is attached to the long portion 241 such that the crank-lever 153 contacts the cushion pad 237 when the stop-bar 227 is engaged. The pull wire 232 is attached from a notch 245 in the short portion 243 to the stop-bar shifter 230 such that the stop-bar shifter 230 moves the stop-bar 227 from its disengaged position (which is shown in phantom in FIG. 10) to its engaged position (which is shown in solid in FIG. 10) against the resisting force of the twist spring 223. The twist spring 223 is attached between the notch 243 on the stop-bar 227 and the stop-bar bracket 224 at the fulcrum 239 such that the twist spring 223 urges the stop-bar 227 into its disengaged position (which is shown in phantom in FIG. 10).

In operation, the stop-bar mechanism 220 is engaged by shifting the stop-bar shifter 230 from a "home" position in such a manner that the pull wire 232 is shortened to thereby pivot the stop bars 226 and 227 laterally into the path of the crank-levers 152 and 153 and thereby expand the twist springs 222 and 223. The stop-bars 226 and 227 and the twist springs 222 and 223 are held in this position by tension on the pull wire 232 until the stop-bar shifter 230 is shifted back to its "home" position.

When the stop-bars 226 and 227 are engaged and the pedal 184 is depressed in the direction of the arrow 198, the crank-lever 152 pivots in the direction of arrow 198 thereby causing the one-way clutch mechanism 176 to become engaged such that torque is transferred between the crank-lever 152 and the spindle 164 and hence rotating the wheel assembly 114 by the same method as described above with respect to the embodiment of FIGS. 1–7. The crank-lever 152 continues to move in the direction of arrow 198 until the user decides to raise the crank-lever 152 by raising his knee or until the crank-lever 152 abuts the stop-bar 226. If the crank-lever 152 contacts the cushion pad 236, the stop-bar 226 prevents the crank-lever 152 from further pivoting about the fulcrum 238. The long portion 240 of the stop-bar 226 is held stationary when the crank-lever 152 is thrust downward into the cushion pad 236 because the short portion 242 is firmly engaged by the stop bracket 228. When the operator moves his knee upward, an upward force is exerted on the pedal strap 188 and the clutch mechanism 176 becomes disengaged such that torque is no longer transferred between the crank-lever 152 and the spindle 164, thereby permitting the long end 182 of the crank-lever 152 to move the pedal 184 and crank-lever 152 in the direction of arrow 199. The crank-lever 152 continues to move in the direction of arrow 199 until the operator again chooses to move the pedal 184 in the direction of arrow 198. Thus, the crank-lever 152 is restricted to a pivoting motion in a range of motion less than 360 degrees, preferably about 120 degrees.

When the stop-bars 226 and 227 are engaged and the pedal 184 is depressed in the direction of the arrow 198, the crank-lever 152 pivots in the direction of arrow 198 thereby causing the one-way clutch mechanism 176 to become engaged such that torque is transferred between the crank-lever 152 and the spindle 164 and hence rotating the wheel assembly 114 by the same method as described above with respect to the embodiment of FIGS. 1–7. The crank-lever 153 continues to move in the direction of arrow 198 until the user decides to raise the crank-lever 153 by raising his knee or until the crank-lever 153 abuts the stop-bar 227. If the crank-lever 153 contacts the cushion pad 237, the stop-bar 227 prevents the crank-lever 153 from further pivoting about the fulcrum 239. The long portion 241 of the stop-bar 227 is held stationary when the crank-lever 153 is thrust downward into the cushion pad 237 because the short portion 243 is firmly engaged by the stop bracket 228. When the operator moves his knee upward, an upward force is exerted on the pedal strap 188 and the clutch mechanism 176 becomes disengaged such that torque is no longer transferred between the crank-lever 152 and the spindle 164, thereby permitting the long end 182 of the crank-lever 152 to move the pedal 184 and crank-lever 152 in the direction of arrow 199. The crank-lever 153 continues to move in the direction of arrow 199 until the operator again chooses to move the pedal 185 in the direction of arrow 198. Thus, the crank-lever 153 is restricted to a pivoting motion in a range of motion less than 360 degrees, preferably about 120 degrees.

In this mode of operation, in which the stop-bars 226 and 227 are engaged, the operator can perform up-down motion either independently, synchronously, or alternately with the crank-levers 152 and/or 153 to the extent that his rehabilitation permits. For example, the operator who is only able to preform minimal up-down movement can begin a rehabilitation program within that minimal range, and as improvement occurs he can increase the range of motion and joint flexion.

The stop-bar mechanism 220 is disengaged by shifting or otherwise returning the stop-bar shifter 230 to its "home" position. Disengaging the stop-bar shifter 230 causes the pull wire 232 to release the tension on the twist springs 222 and 223, which then contract and laterally pivot the stop-bars 226 and 227 out of the path of the crank-levers 152 and 153 (as shown in phantom in FIG. 10). When the pedal 184 is rotated in the direction of arrow 198, the long end 182 of the crank-lever 152 is moved in the same direction. When the crank-lever 152 is moved in the direction of arrow 199, the one-way clutch mechanism 176 becomes engaged and thereby permits the transfer of torque between the crank-lever 152 and the spindle 164 such that the wheel assembly 114 is caused to rotate by the same method as described above with respect to the embodiment of FIGS. 1–7. The crank-lever 152 continues to rotate in the direction of arrow 198 until the user decides to move the crank-lever 152 in the direction of arrow 199. When the crank-lever 152 is moved in the direction of arrow 199, the one-way clutch mechanism 176 becomes disengaged and thereby prevents the transfer of torque between the crank-lever 152 and the spindle 164 such that the wheel assembly 114 is not caused to rotate.

When the pedal 185 is rotated in the direction of arrow 198, the long end 183 of the crank-lever 153 is moved in the same direction. When the crank-lever 153 is moved in the direction of arrow 199, the one-way clutch mechanism 177 becomes engaged and thereby permits the transfer of torque between the crank-lever 153 and the spindle 164 such that the wheel assembly 114 is caused to rotate by the same method as described above with respect to the embodiment of FIGS. 1–7. The crank-lever 153 continues to rotate in the direction of arrow 198 until the user decides to move the crank-lever 153 in the direction of arrow 199. When the crank-lever 153 is moved in the direction of arrow 199, the one-way clutch mechanism 177 becomes disengaged and thereby prevents the transfer of torque between the crank-lever 153 and the spindle 164 such that the wheel assembly 114 is not caused to rotate.

In this mode of operation, in which the stop bars 226 and 227 are disengaged, the operator can achieve a variety of leg motions which may be used for either therapeutic or for exercise purposes. For instance, the operator may independently rotate either crank-lever 152 or 153 while the other crank-lever 153 or 152 is at rest, or the operator may simultaneously rotate both crank-levers 152 and 153 in a conventional bicycle mode of operation or in any other similar mode of operation.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

I claim:

1. An exercise and/or rehabilitation apparatus in the form of an exercise bicycle, comprising a stationary frame having a seat extending upwardly from a rear end of said frame, a wheel rotatably mounted on a front end of said frame, and handlebars extending upwardly from said frame between said rear end thereof and said front end thereof; a first pedal; a second pedal; mounting means for pivotally mounting said first and said second pedals to said frame such that said first pedal is pivotable in a first arcuate direction from an up position to a down position and in a second arcuate direction from its said down position to its said up position and such that said second pedal is pivotable in said first arcuate direction from an up position to a down position and in said second arcuate direction from its said down position to its said up position, said first pedal being pivotable in said first arcuate direction without causing the pivotal movement of said second pedal in said first arcuate direction and being pivotable in said second arcuate direction without causing the pivotal movement of said second pedal in said second arcuate direction, and said second pedal being pivotable in said first arcuate direction without causing the pivotal movement of said first pedal in said first arcuate direction and being pivotable in said second arcuate direction without causing the pivotal movement of said first pedal in said second arcuate direction, whereby said first and second pedals are movable alternately between their said up positions and their said down positions to thereby allow an operator seated on said seat of said frame to move said pedals in a manner which assimilates a walking or jogging motion; and connecting means for connecting said first and second pedals to said wheel such that said wheel is rotated in response to the alternate movement of said first and second pedals between their said up positions and their said down positions.

2. The apparatus according to claim 1, further comprising limiting means for limiting the movement of said first pedal as said first pedal moves in said first arcuate direction to thereby define said down position of said first pedal and for limiting the movement of said second pedal as said second pedal moves in said first arcuate direction to thereby define said down position of said second pedal.

3. The apparatus according to claim 2, wherein said limiting means limits both said up positions and said down positions.

4. The apparatus according to claim 3, wherein said pedals pivot in a partial circular motion only.

5. An exercise and/or rehabilitation apparatus comprising a stationary frame; a first pedal; a second pedal; mounting means for pivotally mounting said first and said second pedals to said frame such that said first pedal is pivotable in a first arcuate direction from an up position to a down position and in a second arcuate direction from its said down position to its said up position and such that said second pedal is pivotable in said first arcuate direction from an up position to a down position and in said second arcuate direction from its said down position to its said up position, said first pedal being pivotable in said first arcuate direction without causing the pivotal movement of said second pedal in said first arcuate direction and being pivotable in said second arcuate direction without causing the pivotal movement of said second pedal in said second arcuate direction, and said second pedal being pivotable in said first arcuate direction without causing the pivotal movement of said first pedal in said first arcuate direction and being pivotable in said second arcuate direction without causing the pivotal movement of said first pedal in said second arcuate direction, whereby said first and second pedals are movable alternately between their said up positions and their said down positions to thereby allow an operator to move said pedals in a manner which assimilates a walking or jogging motion, said mounting means including a hub mounted to said frame, a spindle extending through said hub, first and second crank-levers located at opposite ends of said hub and carrying said first and second pedals respectively, and first and second one-way clutches attaching said first and second crank-levers to respective ends of said spindle such that said first and second crank-levers are pivotable in said first and said second arcuate directions and such that said first and second crank-levers rotate said spindle only when moved in said first arcuate direction; and limiting means for limiting the movement of said first pedal as said first pedal moves in said first and second arcuate directions to thereby define said down and up positions of said first pedal such that said first pedal pivots in a partial circular motion only and for limiting the movement of said second pedal as said second pedal moves in said first and second arcuate directions to thereby define said down and up positions of said second pedal such that said second pedal pivots in a partial circular motion only.

6. The apparatus according to claim 5, wherein said limiting means includes oscillating means for moving said first crank-lever in said second arcuate direction to its said up position when said second crank-lever is moved in said first arcuate direction to its said down position and for moving said second crank-lever in said second arcuate direction to its said up position when said first crank-lever is moved in said first arcuate direction to its said down position.

7. The apparatus according to claim 6, wherein said oscillating means includes a rear axle attached to said frame, first and second sprockets fixedly attached to opposite ends of said rear axle, and first and second chain segments attaching said first and second crank-levers to said first and second sprockets, respectively, whereby said crank-levers are oscillated in opposite arcuate directions.

8. The apparatus according to claim 7, further comprising a variable resistance means for imparting a varying resistance to the motion of said first and second pedals.

9. The apparatus according to claim 8, wherein said variable resistance means includes a wheel rotatably mounted to said frame within an adjustable resistive belt, a third sprocket fixedly attached to said spindle, a fourth sprocket fixedly attached to said wheel, and a chain trained around said third and fourth sprockets such that said wheel rotates in response to the movement of said first and/or said second pedals in said first arcuate direction.

10. The apparatus according to claim 9, wherein said first and second pedals pivot through an arc of approximately 120 degrees.

11. An exercise and/or rehabilitation apparatus, comprising a stationary frame; a first pedal; a second pedal; mounting means for pivotally mounting said first and said second pedals to said frame such that said first pedal is pivotable in a first arcuate direction from an up position to a down position and in a second arcuate direction from its said down position to its said up position and such that said second pedal is pivotable in said first arcuate direction from an up position to a down position and in said second arcuate direction from its said down position to its said up position, said first pedal being pivotable in said first arcuate direction without causing the pivotal movement of said second pedal in said first arcuate direction and being pivotable in said second arcuate direction without causing the pivotal movement of said second pedal in said second arcuate direction, and said second pedal being pivotable in said first arcuate direction without causing the pivotal movement of said first pedal in said first arcuate direction and being pivotable in said second arcuate direction without causing the pivotal movement of said first pedal in said second arcuate direction, whereby said first and second pedals are movable alternately between their said up positions and their said down positions to thereby allow an operator to move said pedals in a manner which assimilates a walking or jogging motion; and limiting means for limiting the movement of said first pedal as said first pedal moves in said first arcuate direction to thereby define said down position of said first pedal and for limiting the movement of said second pedal as said second pedal moves in said first arcuate direction to thereby define said down position of said second pedal, wherein said limiting means defines said down positions only.

12. The apparatus according to claim 11, wherein said pedals pivot in a full or partial circular motion.

13. The apparatus according to claim 12, wherein said mounting means includes a hub mounted to said frame; a spindle extending through said hub; first and second crank-levers located at opposite ends of said hub and carrying said first and second pedals respectively; and first and second one-way clutches attaching said first and second crank-levers to respective ends of said spindle such that said first and second crank-levers are pivotable in said first and said second arcuate directions and such that said first and second crank-levers rotate said spindle only when moved in said first arcuate direction.

14. The apparatus according to claim 13, wherein wherein said limiting means includes a first stop-bar movable between a retracted position, in which said first stop-bar is out of the path of travel of said first crank-lever, and an extended position, in which said first stop-bar is in the path of travel of said first crank-lever to thereby define said down position of said first crank-lever, and a second stop-bar movable between a retracted position, in which said second stop-bar is out of the path of travel of said second crank-lever, and an extended position, in which said second stop-bar is in the path of travel of said second crank-lever to thereby define said down position of said second crank-lever.

15. The apparatus according to claim 14, wherein said limiting means further includes moving means for moving said first stop-bar between its said extended position and its said retracted position and for moving said second stop-bar between its said extended position and its said retracted position.

16. The apparatus according to claim 15, wherein said limiting means further includes first urging means for urging said first stop-bar into its retracted position, second urging means for urging said second stop-bar into its retracted position, and pulling means for pulling said first and second stop-bars into their extended positions from their retracted positions.

17. The apparatus according to claim 16, wherein said urging means includes springs and wherein said pulling means includes a hand-operated shifter.

18. The apparatus according to claim 17, further comprising a variable resistance means for imparting and varying resistance to the motion of said first and second pedals.

19. The apparatus according to claim 18, wherein said variable resistance means includes a wheel rotatably mounted to said frame within an adjustable resistive belt, a first sprocket fixedly attached to said spindle, a second sprocket fixedly attached to said wheel, and a chain trained around said first and second sprockets such that said wheel rotates in response to the movement of said first and/or said second pedals in said first arcuate direction.

20. The apparatus according to claim 5, wherein said frame includes a seat and handlebars, whereby said apparatus is in the form of an exercise bicycle.

21. The apparatus according to claim 11, wherein said frame includes a seat and handlebars, whereby said apparatus is in the form of an exercise bicycle.

22. The apparatus according to claim 2, wherein said limiting means defines said down positions only.

23. The apparatus according to claim 22, wherein said pedals pivot in a full or partial circular motion.

24. The apparatus according to claim 1, further comprising variable resistance means for imparting a varying resistance to the motion of said first and second pedals, said variable resistance means including said wheel.

* * * * *